US006774313B2

(12) United States Patent
Chi-Sheng et al.

(10) Patent No.: US 6,774,313 B2
(45) Date of Patent: Aug. 10, 2004

(54) INSULATING DEVICE

(75) Inventors: Chen Chi-Sheng, Taoyuan Shien (TW); Hsieh Tung-Yun, Taoyuan Shien (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 10/404,621

(22) Filed: Mar. 31, 2003

(65) Prior Publication Data

US 2003/0183414 A1 Oct. 2, 2003

(30) Foreign Application Priority Data

Apr. 1, 2002 (TW) ..... 91204136 U

(51) Int. Cl.[7] ..... H01B 7/00
(52) U.S. Cl. ..... 174/138 G; 174/135
(58) Field of Search ..... 174/135, 137 R, 174/138 G, 152 G, 157, 163 R; 361/746, 752, 757, 758, 804

(56) References Cited

U.S. PATENT DOCUMENTS 3,836,704 A * 9/1974 Coules ..... 174/138 D
4,489,243 A * 12/1984 Nola ..... 307/64
4,495,515 A * 1/1985 Pamiello ..... 174/138 G
4,587,377 A * 5/1986 Rodseth ..... 174/138 G
4,602,125 A * 7/1986 West et al. ..... 174/138 G
4,886,940 A * 12/1989 Gagnon et al. ..... 174/88 B
4,969,065 A * 11/1990 Petri ..... 361/804
5,512,801 A * 4/1996 Nilssen ..... 315/209 R
5,750,936 A * 5/1998 Wheatley et al. ..... 174/138 G
6,091,614 A * 7/2000 Malenfant ..... 363/97
6,104,143 A * 8/2000 Bonavia ..... 315/209 CD
6,225,566 B1 * 5/2001 Dienst ..... 174/138 E
6,333,855 B2 * 12/2001 Prabaonnaud et al. .. 174/138 G
2003/0127243 A1 * 7/2003 Chi-Sheng et al. ..... 174/148
2003/0184930 A1 * 10/2003 Chi-Sheng et al. ..... 174/138 G

* cited by examiner

*Primary Examiner*—Dean A. Reichard
*Assistant Examiner*—Adolfo Nino

(57) ABSTRACT

An insulating device for insulating an electronic device from an object having at least a hole is provided. The insulating device includes a metal plate having at least a recess and fixing the electronic device thereon, a hollow insulating washer disposed in said recess, and a fastening element disposed in the hollow insulating washer for fastening the electronic device to the object by means of passing through the hollow insulating washer and the at least a hole of the object, so as to insulate the electronic device from the object.

12 Claims, 3 Drawing Sheets

INSULATING DEVICE

FIELD OF THE INVENTION

The present invention relates to an insulating device, and more particularly to an insulating device for primarily insulating the current leakage of the electronic device.

BACKGROUND OF THE INVENTION

In a conventional electronic device, the outer shell of the electronic device is usually made of a metal for protecting the inner part of the electronic device. Although the outer shell made of a metal can strengthen the outer structure of the electronic device and protect the inner element of the electronic device, it also induces the current leakage problem in the electronic device while the electronic device operates. That would reduce the life of the electronic device or other peripheral devices.

Please refer to FIG. 1. It is a schematic diagram illustrating a power factor regulator of the prior art. Typically, a power factor regulator includes a main body 1, a shell 2 and a cover 5. The shell 2 is used for containing the main body 1 inside. The shell 2 is made of metal and has two extended parts 3 which are extended from the bottom of the shell 2. Each of the extended parts 3 further has plural threaded holes 4 for fastening the power factor regulator on a case (not shown in figure). However, the shell 2 and the cover 5 of the dower factor regulator, the extended parts 3 and the screws are all made of metals. Also, metal has good electronic conduction property. Hence, the structure of the prior power factor regulator would induce the current leakage, and then damage the electronic device and the other peripheral devices. It is very dangerous for users. Furthermore, if the main board is also made of metal, the current leakage would be induced more seriously while the electrical device is fixed on the main board.

Therefore, it is tried to rectify this drawback and provide an electrical device having an insulating structure by the present applicant.

SUMMARY OF THE INVENTION

It is an object of the present invention to provide an insulating device for an insulating on electrical device. At the same time, the insulating device can strengthen the structure thereof. In addition, the insulating device can prevent the electronic device from the current leakage situation while the electronic device is under operation.

According to an aspect of the present invention, the insulating device for insulating an electronic device is providing. The insulating device for insulating an electrical device from an object having at least a hole includes a metal plate having at least a recess and fixing the electronic device thereon, a hollow insulating washer disposed in the recess, and a fastening element disposed in the hollow insulating washer for fastening the electronic device to the object by means of passing through the hollow insulating washer and the at least a hole of the object, so as to insulate the electronic device from the object.

Preferably, the electronic device is a transformer.

Alternatively, the electronic device is a power factor controller.

Preferably, the power factor controller further comprises a coil ferrule and a magnetic core disposed on the coil ferrule.

Preferably, the coil ferrule is composed of an insulating material.

Preferably, the metal plate includes a rib disposed in the recess orientating the hollow insulating washer.

Preferably, the at least a recess is disposed in a side of the metal plate.

Preferably, the fastening element is a screw.

Alternatively, the fastening element is a bolt.

Alternatively, the fastening element is a rivet.

Preferably, the hollow insulating washer is made of plastics.

Preferably, the hollow insulating washer is bone-shaped.

Preferably, the hollow insulating washer is engaged with said recess.

Preferably, the recess is a semicircular fillister.

Alternatively, the object is a case.

Alternatively, the object is a motherboard.

According to another aspect of the present invention, the insulating device for insulating an electronic device from an object having at least a hole, includes a metal plate fixing the electronic device thereon, at least a hollow insulating washer disposed on a side of the metal plate, and at least a fastening element disposed in the at least a hollow insulating washer for fastening the electronic device on the object by means of passing through the at least a hollow insulating washer and the at least a hole of the object, so as to insulate the electronic device from the object.

The foregoing and other features and advantages of the present invention will be more clearly understood through the following descriptions with reference to the drawings, wherein:

DETAILED DESCRIPTION OF THE PREFERRED EMBODIMENT

Figure 1:
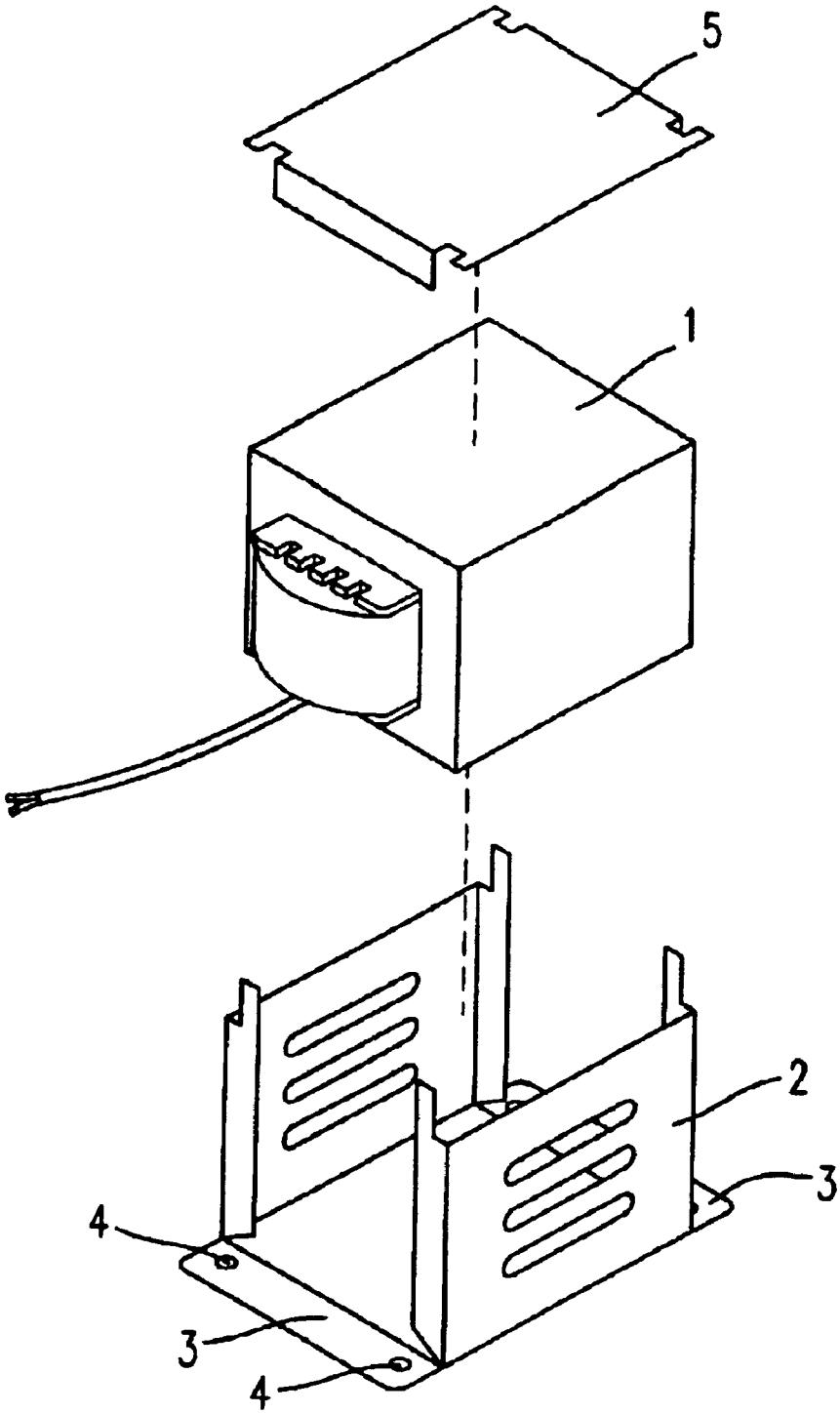
Fig. 1 (PRIOR ART)
FIG. 1 illustrates a power factor regulator of the prior art.
Figure 2:
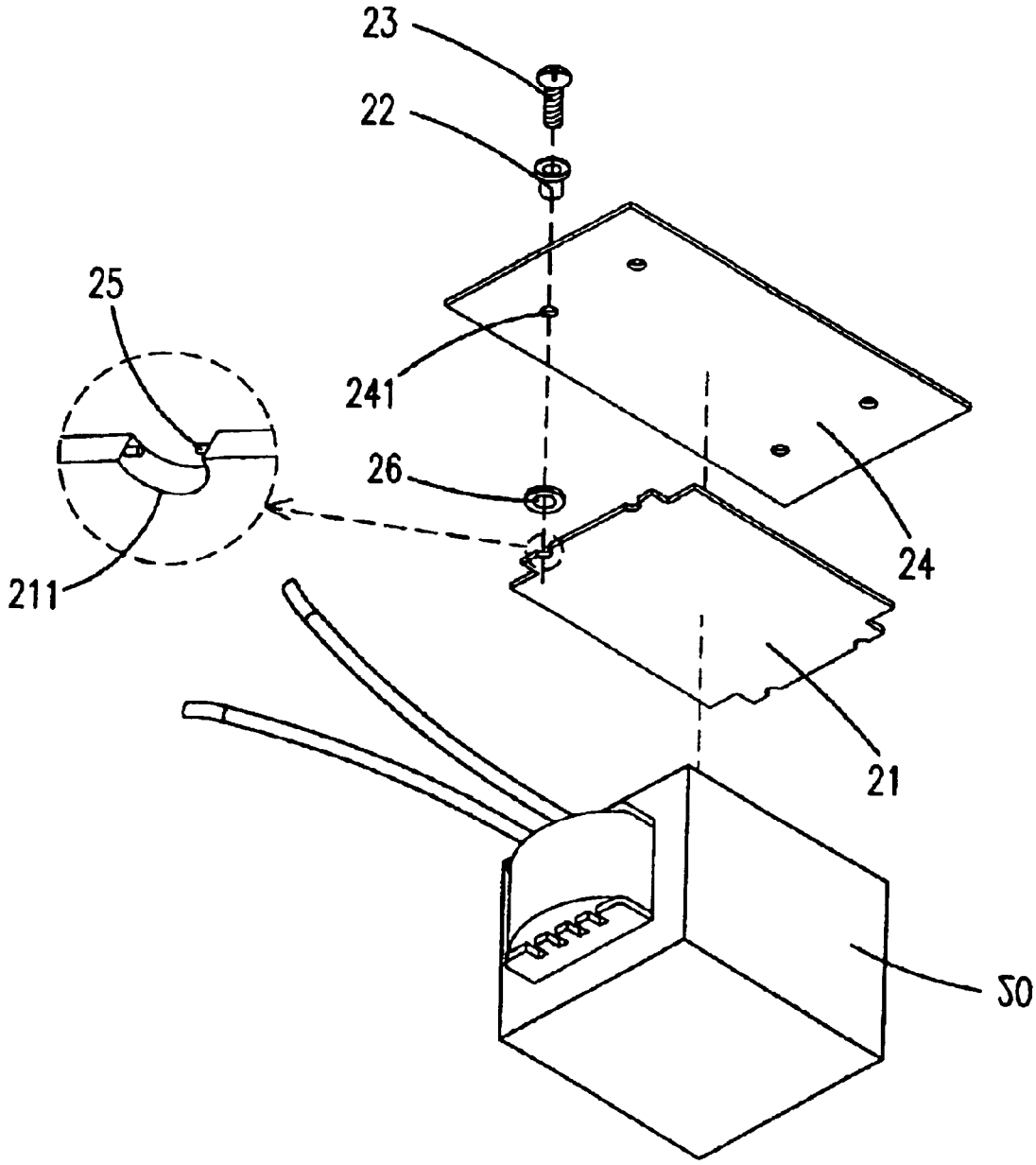
FIG. 2 illustrates a first preferred embodiment of the present invention of a power factor regulator.

Please refer to FIG. 2. FIG. 2 illustrates a preferred embodiment of the present invention of a power factor regular. The electronic device having an insulating structure includes a main body 20, a hollow insulating washer 26 and a fastening element 23. Meanwhile, the metal plate 21 is disposed on the bottom of the main body 20 and one side of the metal plate 21 includes at least one recess 211 for providing the fastening element 23 which is contained in the washer 22. The fastening element 23 penetrates through the washer 22 and the at least a hole 241 of an object 24, and is disposed in the hollow insulating washer 26 so as to disposed the main body 20 on the object 24. Thereby, the main body 20 is insulated from the object 24 by means of the hollow insulating washer 26.

In the preferred embodiment, the main body 20 usually is a transformer or a power factor controller. The power factor controller further includes a coil ferrule and a magnetic core. The coil ferrule is composed of an insulating material. Considering the weight of the main body 20, the better fastening element 23 is a metal screw or bolt. However, it can be any plastic fastening element, too. The object 24 usually is a case or a motherboard.

Another side of the metal plate 21 further includes additional recesses for strengthen to dispose the main body 20 on the object 24. The better material of the hollow insulating washer 26 is plastic for ensuring the insulation of the main body 20.

The better material of the hollow insulating washer 26 is plastic, so when the fastening element 23 is engaged with the recess 211, the hollow insulating washer 26 expands to fill the recess 211 so as to dispose the hollow insulating washer 22 in the recess 211 firmly. Meanwhile, the recess 211 also includes a rib 25 for orientating the hollow insulating washer 22 in the recess 211.

Figure 3:
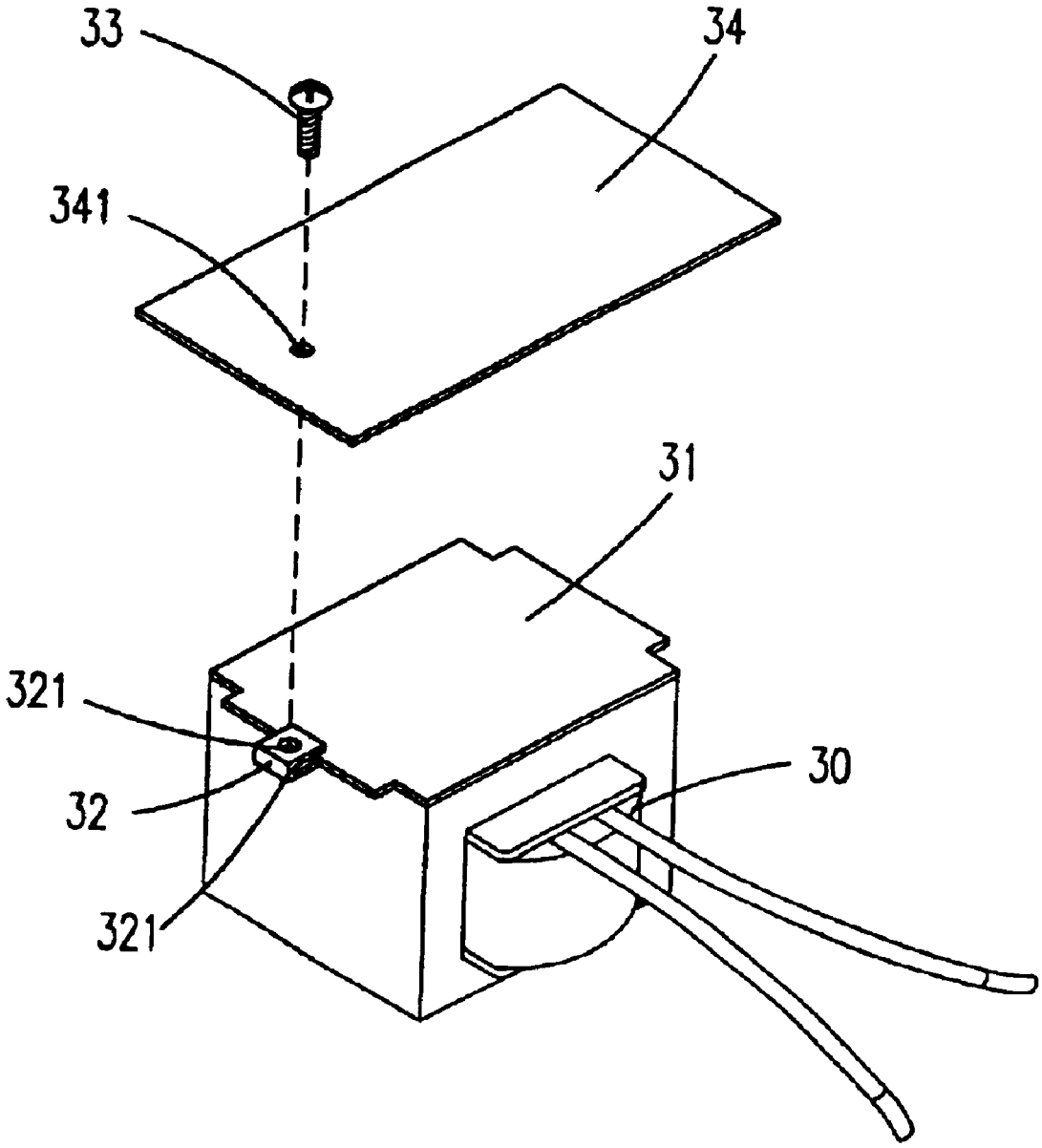
FIG. 3 illustrates a second preferred embodiment of the present invention of a power factor regulator.

Please refer to FIG. 3. FIG. 3 illustrates a second preferred embodiment of the present invention. The electronic device having an insulating structure includes a main body 30, a hollow insulating washer 32 and a fastening element 33. Meanwhile, the metal plate 31 is disposed on the bottom of the main body 30 and the hollow insulating washer 32 having the holes 321 is disposed on one side of the metal plate 31. The fastening element 33 penetrates through a hole 341 of a object 34 and the holes 321 of the hollow insulating washer 32 so as to dispose the main body 30 on the object 34. Therefore, the main body 30 is insulated by means of insulating of the hollow insulating washer 32.

Finally, the fastening elements of the present invention fix the electronic device on the mental case for completely protecting by the insulating washer. That is, the insulating device of the present invention can accomplish the purposes of preventing the electronic device from current leakage problem. Accordingly, the insulating device of the present invention is capable of strengthening structure and insulating current, and then prevents the current leakage problem of the conventional electronic device.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation, so as to encompass all such modifications and similar structures.

What is claimed is:

1. An insulating device for insulating an electronic device from an object having at least a hole, comprising:

a metal plate having at least a recess and fixing said electronic device thereon;

a hollow insulating washer disposed in said recess; and a fastening element disposed in said hollow insulating washer for fastening said electronic device to said object by means of passing through said hollow insulating washer and said at least a hole of said object, so as to insulate said electronic device from said object, wherein said recess has a rib for orientating said hollow insulating washer in said recess.

2. The device according to claim 1, wherein said electronic device is a transformer.

3. The device according to claim 1, wherein said electronic device is a power factor controller.

4. The device according to claim 1, wherein said at least a recess is disposed in a side of said metal plate.

5. The device according to claim 1, wherein said fastening element is a screw.

6. The device according to claim 1, wherein said hollow insulating washer is made of plastic.

7. The device according to claim 1, wherein said hollow insulating washer is bone-shaped.

8. The device according to claim 1, wherein said hollow insulating washer is engaged with said recess.

9. The device according to claim 1, wherein said recess is a semicircular fillister.

10. The device according to claim 1, wherein said object is a case.

11. The device according to claim 1, wherein said object is a motherboard.

12. An insulating device for insulating an electronic device from an object having at least a hole, comprising:

a metal plate fixing said electronic device thereon;

at least a hollow insulating washer disposed on a side of said metal plate; and at least a fastening element disposed in said at least a hollow insulating washer for fastening said electronic device on said object by means of passing through said at least a hollow insulating washer and said at least a hole of said object, so as to insulate said electronic device from said object.

* * * * *